US006497223B1

(12) United States Patent
Tuken et al.

(10) Patent No.: US 6,497,223 B1
(45) Date of Patent: Dec. 24, 2002

(54) FUEL INJECTION PRESSURE CONTROL SYSTEM FOR AN INTERNAL COMBUSTION ENGINE

(75) Inventors: Taner Tuken, Columbus, IN (US); Donald J. Benson, Columbus, IN (US); John T. Carroll, III, Columbus, IN (US); Yul J. Tarr, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 09/564,240

(22) Filed: May 4, 2000

(51) Int. Cl.[7] ..... F02M 37/04
(52) U.S. Cl. ..... 123/497; 123/456
(58) Field of Search ..... 123/497, 467, 123/447, 456, 499

(56) References Cited

U.S. PATENT DOCUMENTS

| | | | | |
|---|---|---|---|---|
| 3,987,763 A | | 10/1976 | Klomp | 123/8.45 |
| 4,593,666 A | | 6/1986 | Lefevre et al. | 123/480 |
| 4,727,836 A | | 3/1988 | Oshizawa et al. | 123/357 |
| 5,055,758 A | | 10/1991 | Hock | 318/645 |
| 5,293,852 A | | 3/1994 | Lehner et al. | 123/339 |
| 5,315,976 A | | 5/1994 | Birk et al. | 123/357 |
| 5,355,859 A | * | 10/1994 | Webber | 123/497 |
| 5,379,741 A | * | 1/1995 | Matysiewicz et al. | 123/497 |
| 5,722,373 A | * | 3/1998 | Paul et al. | 123/446 |
| 5,775,304 A | * | 7/1998 | Kono et al. | 123/497 |
| 5,848,583 A | * | 12/1998 | Smith et al. | 123/497 |
| 6,016,791 A | * | 1/2000 | Thomas et al. | 123/497 |

* cited by examiner

*Primary Examiner*—Willis R. Wolfe
*Assistant Examiner*—Mahmoud Gimie
(74) *Attorney, Agent, or Firm*—Barnes & Thornburg

(57) ABSTRACT

A fuel injection pressure control system includes a control strategy operable to measure or estimate actual fuel injection pressure and control the operation of a fuel supply pump to thereby quickly and accurately control fuel injection pressure. The control strategy includes a closed-loop control strategy operable to compensate for instantaneous changes in system non-linearities, including fuel pump non-linearities and the like, and an open-loop control strategy operable to compensate for all system variations as well as system non-linearities, including between-engine variations in system operating parameters and other noise factors including deteriorating conditions, changes in environment and the like. Each strategy includes an adaptive controller operable to update one or more control parameters to thereby guarantee closed-loop stability, provide for fast and accurate system response during transient events, and minimize overshoots and undershoots.

27 Claims, 6 Drawing Sheets

FUEL INJECTION PRESSURE CONTROL SYSTEM FOR AN INTERNAL COMBUSTION ENGINE

FIELD OF THE INVENTION

The present invention relates generally to fuel systems for internal combustion engines, and more specifically to such systems including one or more fuel pumps responsive to one or more corresponding pump actuation signals to supply high pressure fuel to associated fuel collection units.

BACKGROUND OF THE INVENTION

In recent years, advances in fuel systems for internal combustion engines, and particularly for diesel engines, have increased dramatically. However, in order to achieve optimal engine performance at all operating conditions with respect to fuel economy, exhaust emissions, noise, transient response, and the like, further advances are necessary. As one example, operational accuracy with electronically controlled fuel systems can be improved by providing for fast and accurate control of fuel injection pressure independent of engine timing, engine speed and engine load.

Heretofore, conventional electronic fuel pressure control systems have employed known control techniques, including open or closed loop strategies, for controlling the operation of high pressure fuel pumps and, in turn, fuel injection pressure. However, while some such techniques have been designed to control fuel pressure under both steady state and transient operating conditions to therefore provide for the ability to quickly and accurately modify fuel injection pressure, no such control techniques are known that further provide for compensation of engine-to-engine (i.e., between-engine) variations in operating parameters as well as system non-linearities. Moreover, no fuel pressure control systems are known wherein such control techniques are adaptively adjustable to thereby maintain accuracy under all engine and fuel system operating conditions including controllable factors such as engine timing, fuel quantity, and the like, and typically uncontrollable factors (i.e., noise factors) such as environment, deterioration, duty cycle, and the like. What is therefore needed is an improved fuel injection pressure control strategy operable to control fuel pump operation under both steady state and transient conditions to thereby provide for fast and accurate control of fuel injection pressure, and to furthermore adaptively adjust such fast and accurate fuel pump control to thereby compensate for between-engine operating parameter variations as well as system non-linearities.

SUMMARY OF THE INVENTION

The foregoing shortcomings of the prior art are addressed by the present invention. In accordance with one aspect of the present invention, a fuel injection pressure control system for an internal combustion engine comprises a fuel pump responsive to a fuel pump command to supply pressurized fuel, means responsive to at least a desired injection pressure for determining the fuel pump command as a function thereof, and means responsive to at least a desired injection pressure and the fuel pump command for revising the function.

In accordance with another aspect of the present invention, a fuel injection pressure control system for an internal combustion engine comprises a fuel pump responsive to a fuel pump command to supply pressurized fuel, means for determining an injection pressure corresponding to a pressure of fuel supplied by the fuel pump and dispensed into a combustion chamber of an internal combustion engine, means for producing an initial fuel pump command, means responsive to the desired injection pressure and the injection pressure for determining a fuel pump adjustment command based on a predefined control strategy, means responsive to the injection pressure and the fuel pump command for revising at least one control parameter of the predefined control strategy, and means for producing the fuel pump command as a function of the initial fuel pump command and the fuel pump adjustment command.

In accordance with yet another aspect of the present invention, a fuel injection pressure control system for an internal combustion engine comprises a fuel pump responsive to a fuel pump actuation signal to supply pressurized fuel, means for determining an injection pressure corresponding to a pressure of fuel supplied by the fuel pump and dispensed into a combustion chamber of an internal combustion engine, and a control circuit including a closed-loop control strategy producing a first control signal as a function of a difference between the injection pressure and a desired injection pressure value and an open-loop control strategy producing a second control signal as a function of at least the desired injection pressure value, the control circuit producing the fuel pump actuation signal as a function of the first and second control signals.

In accordance with a further aspect of the present invention, a method for controlling fuel injection pressure in an internal combustion engine comprises the steps of determining an injection pressure corresponding to a pressure of fuel dispensed into a combustion chamber of an internal combustion engine, producing an initial fuel pump command as a function of at least one control parameter of an open-loop control strategy, producing a fuel pump adjustment command as a function of at least one control parameter of a closed-loop control strategy, producing a fuel pump command as a function of the initial fuel pump command and the fuel pump adjustment command, the fuel pump command controlling operation of a fuel pump supplying fuel for dispensing into the combustion chamber, updating the at least one control parameter of the open-loop control strategy as a function of at least a desired injection pressure and the fuel pump command, and updating the at least one control parameter of the closed-loop control strategy as a function of the injection pressure and the fuel pump command.

One object of the present invention is to provide an improved strategy for controlling fuel injection pressure in an internal combustion engine.

Another object of the present invention is to provide such an improved strategy by controlling the operation of a fuel pump operable to supply high pressure fuel for subsequent dispensing into a combustion chamber of the engine.

Yet another object of the present invention is to provide such an improved strategy by combining closed loop and open loop strategies to thereby control both steady state and transient operating conditions.

Still another object of the present invention is to provide such an improved strategy by adaptively adjusting the closed loop and open loop control parameters to thereby compensate for between-engine operating parameter variations as well as system non-linearities.

These and other objects of the present invention will become more apparent from the following description of the preferred embodiments.

DESCRIPTION OF THE PREFERRED EMBODIMENTS

Figure 1A:
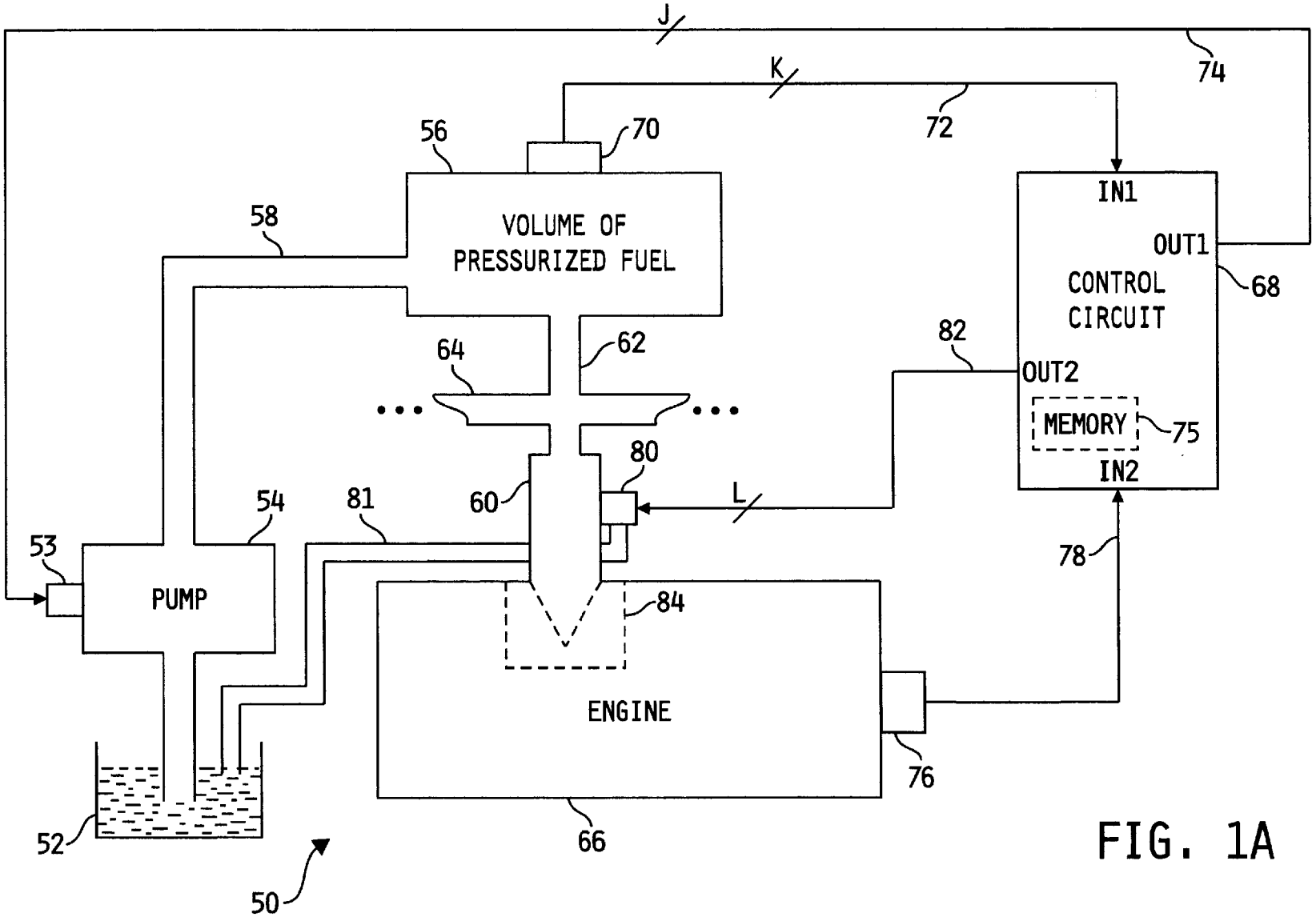
FIG. 1A is a diagrammatic illustration of one embodiment of a fuel control system for an internal combustion engine, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1A, one preferred embodiment of an electronic fuel control system 50, in accordance with the present invention, is shown. Fuel control system 50 includes a source of fuel 52; e.g. diesel engine fuel, having an inlet port of a fuel pump 54 in fluid communication therewith. Fuel source 52 is, in one embodiment, a low pressure fuel pump providing low pressure fuel to pump 54. In any case, fuel pump 54 is preferably a high pressure pump configured to supply high pressure fuel from fuel supply 52 to a fuel collection unit 56, in a cyclic fashion, via supply passage 58. The present invention contemplates, however, that fuel pump 54 may alternatively be configured to supply high pressure fuel from fuel supply 52 to a fuel collection unit 56 in a non-cyclic fashion. In any case, fuel collection unit 56 is fluidly connected to a fuel injector 60 via supply passage 62, and fuel injector 60 is configured to be mounted to an internal combustion engine 66 in fluid communication with a combustion chamber 84 thereof as is known in the art. Fuel collection unit 56 may optionally be fluidly coupled to additional fuel injectors via supply passage 64. In the embodiment shown in FIG. 1A, the fuel collection unit 56 is conventionally referred to as a fuel storage unit, or fuel accumulator.

Central to the electronic control of pump 54 and injector 60 is a control circuit 68 having a memory unit 75 associated therewith. In one embodiment, control circuit 68 is a control computer of known construction, wherein such a circuit 68 is typically referred to by those skilled in the art as an engine control module (ECM), engine control unit (ECU) or the like, although the present invention contemplates that control circuit 68 may alternatively be any electrical circuit capable of performing the functions described hereinafter with respect to circuit 68. In any case, control circuit 68 is operable, at least in part, to control the fueling of engine 66 in accordance with one or more software algorithms stored within memory unit 75.

System 50 includes a number of sensors and/or sensor subsystems for providing control circuit 68 with operational information relating to some of the components of system 50 as well as certain engine operating information. For example, fuel collection unit 56 includes a pressure sensor 70 electrically connected to an input IN1 of control circuit 68 via a number, K, of signal paths 72 wherein K may be any positive integer. Sensor 70 is preferably a known sensor operable to sense the pressure of the volume of pressurized fuel within collection unit 56 and provide a fuel pressure signal corresponding thereto to input IN1 of control circuit 68 via signal paths 72, as is known in the art. System 50 further includes an engine speed/position sensor 76 electrically connected to an input IN2 of control circuit 68 via signal path 78. In one embodiment, sensor 76 is a known engine speed/position sensor including a Hall effect sensor disposed proximate to a toothed gear or wheel rotating synchronously with the crankshaft of the engine (not shown). Preferably, the toothed gear or wheel includes a number of equi-angularly spaced teeth as well as an extra tooth disposed between adjacent ones of the equi-angularly spaced teeth. Sensor 76 is operable to produce an engine speed/position signal including information relating to the rotational speed of the engine crank shaft (not shown) based on the passage thereby of the equi-angularly spaced teeth, as well as information relating to engine position relative to a reference engine position (e.g., angle of the crank shaft (crank angle) relative to a top-dead-center (TDC) position of the engine cylinder or combustion chamber in question) based on passage thereby of the extra tooth. Alternatively, system 50 may substitute the sensor 76 just described with one or more known sensors producing equivalent information in the form of one or more electrical signals.

Control circuit 68 further includes a number of outputs by which certain components of system 50 may be electronically controlled. For example, output OUT1 of control circuit 68 is electrically connected to an actuator 53 of fuel pump 54 via a number, J, of signal paths 74, wherein J may be any positive integer and wherein actuator 53 may be a solenoid or other known actuator. In any case, actuator 53 of pump 54 is responsive to a pump command signal produced by control circuit 68 on signal paths 74 to cause the pump 54 to supply fuel from fuel supply 52 to fuel collection unit 56. Output OUT2 of control circuit 68 is electrically connected to an actuator 80 (e.g., solenoid) of fuel injector 60 via a number, L, of signal paths 82, wherein L may be any positive integer, and whereby actuator 80 is responsive to a fuel command signal produced by control circuit 68 on signal path 82 to actuate injector 60 to thereby dispense a quantity of fuel from fuel collection unit 56 into a combustion chamber of engine 66. Additionally, actuator 80 is operable to direct unused (non-injected) fuel supplied thereto to fuel source 52 via fuel passageway 81, as is known in the art.

It is to be understood that system 50 may include any number of fuel pumps 54, fuel collection units 56 and fuel injectors 60. Fuel pressure sensor 70 is accordingly shown as being electrically connected to input IN1 of control circuit 68 via a number, K, of signal paths and output OUT1 of control circuit 68 is shown as being electrically connected to fuel pump actuator 53 via a number, J, of signal paths. Likewise, fuel injector actuator 80 is shown as being electrically connected to output OUT2 of control circuit 68 via a number, L, of signal paths. In one particular embodiment, for example, system 50 includes six fuel injectors 60, two fuel pumps 54 and two fuel collection units 56, wherein each of the two fuel pumps is operable to supply high pressure fuel to a separate fuel collection unit 56, and wherein each of the two collection units 56 is operable to supply fuel to separate banks of three injectors 60 each.

Figure 1B:
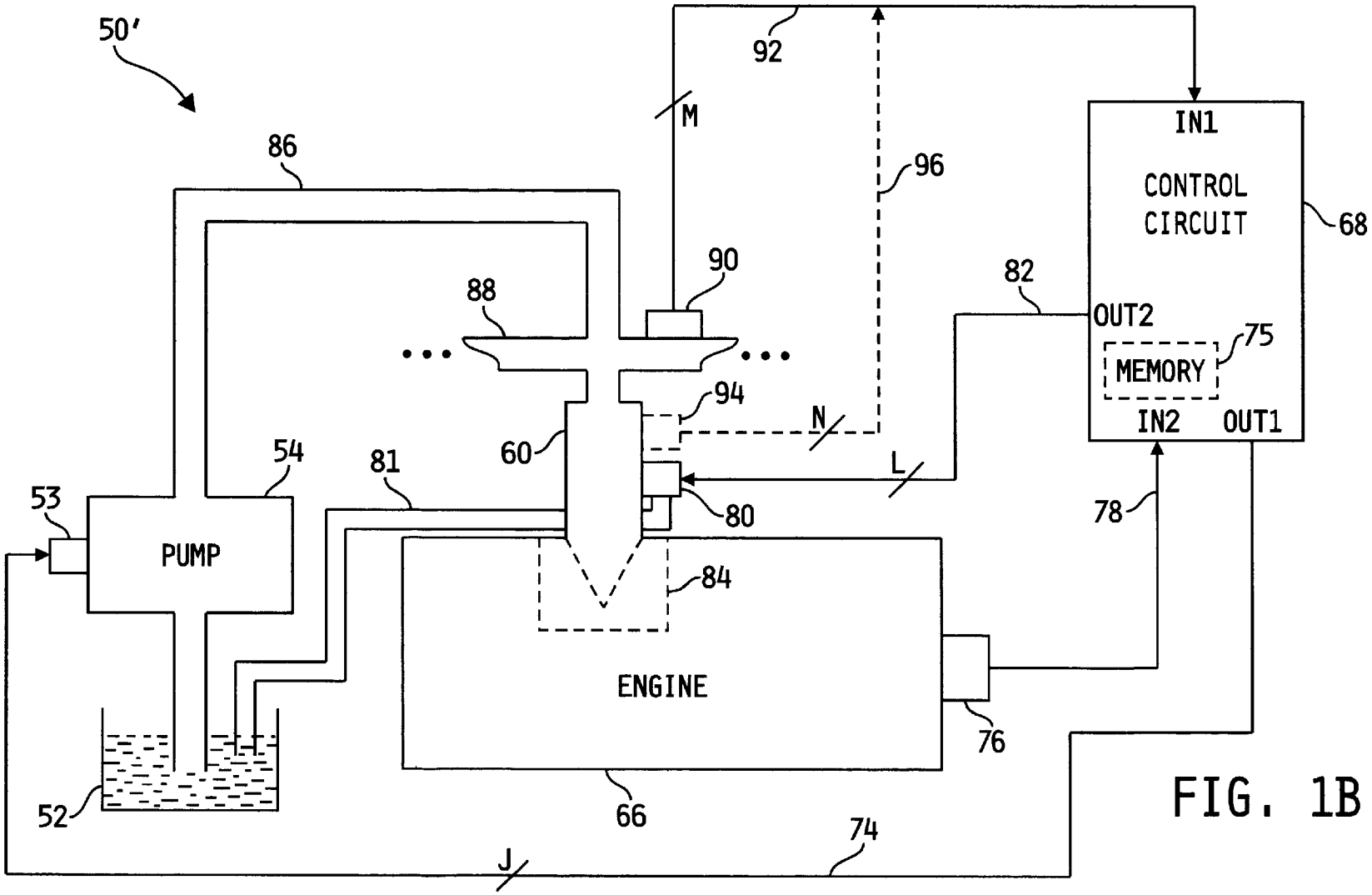
FIG. 1B is a diagrammatic illustration of an alternate embodiment of a fuel control system for an internal combustion engine, in accordance with the present invention.

Referring now to FIG. 1B, an alternative embodiment of an electronic fuel control system 50', in accordance with the present invention, is shown. System 50' is identical in many respects to system 50 of FIG. 1A, and like reference numbers are therefore used to identify like components. System 50' of FIG. 1B differs from system 50 of FIG. 1A in that fuel pump 54 is fluidly connected directly to a so-called fuel "rail" 88 via supply passage 86, wherein the fuel rail 88 is fluidly connected to injector 60 and optionally to a number of additional fuel injectors (not shown). In one embodiment of the fuel control system 50' illustrated in FIG. 1B, the "fuel collection unit" is comprised of the fuel rail 88, wherein a pressure sensor 90 suitably located relative to rail 88 is electrically connected to input IN1 of control circuit 68 via a number, M, of signal paths 92 wherein M may be any positive integer. In this embodiment, pressure sensor 90 is operable to sense the pressure of fuel within fuel rail 88 and provide a fuel pressure signal corresponding thereto. In an alternative embodiment of the system 50' illustrated in FIG. 1B, the "fuel collection unit", as this term is used hereinabove, is comprised of the fuel storage portion of fuel injector 60, whereby a pressure sensor 94 suitable located relative to injector 60 is electrically connected to input IN1 of control circuit 68 via a number, N, of signal paths 96 as shown in phantom in FIG. 1B, wherein N may be any positive integer. In this embodiment, pressure sensor 94 is operable to sense the pressure of fuel within injector 60 and provide a fuel pressure signal corresponding thereto. It is to be understood that in either embodiment of the fuel control system 50' of FIG. 1B, any number of fuel injectors 60 may be included therein, any number of fuel rails 88 may be provided and fluidly connected to any desired combinations or groupings of fuel injectors 60, and any number of fuel pumps 54 may be provided and fluidly connected to the one or more fuel rails 88 via suitable passageways 86. Fuel pressure sensor 90 is accordingly shown as being electrically connected to input IN1 of control circuit 68 via a number, M, of signal paths, fuel pressure sensor 94 is shown as being electrically connected to input IN1 of control circuit 68 via a number, N, of signal paths, output OUT1 of control circuit 68 is shown as being electrically connected to actuator 53 of fuel pump 54 via a number, J, of signal paths and output OUT2 of control circuit 68 is shown as being electrically connected to fuel injector actuator 80 via a number, L, of signal paths. In one particular embodiment, for example, system 50' includes six fuel injectors 60, two fuel pumps 54 and two fuel rails 88, wherein each of the two fuel pumps 54 is operable to supply high pressure fuel to a separate fuel rail 88, and each of the two fuel rails 88 is operable to supply fuel to a separate bank of three injectors 60 each.

In any case, it should now be readily apparent that the term "fuel collection unit", as it relates to the present invention, may be understood to identify any of an accumulator-type storage unit, such as unit 56 of FIG. 1A, a fuel rail-type storage unit, such as fuel rail 88, or a fuel injector-type storage unit, such as the fuel storage portion of injector 60, and that the term "fuel storage pressure" refers to the pressure of fuel stored within any of the foregoing fuel collection units.

Figure 1C:
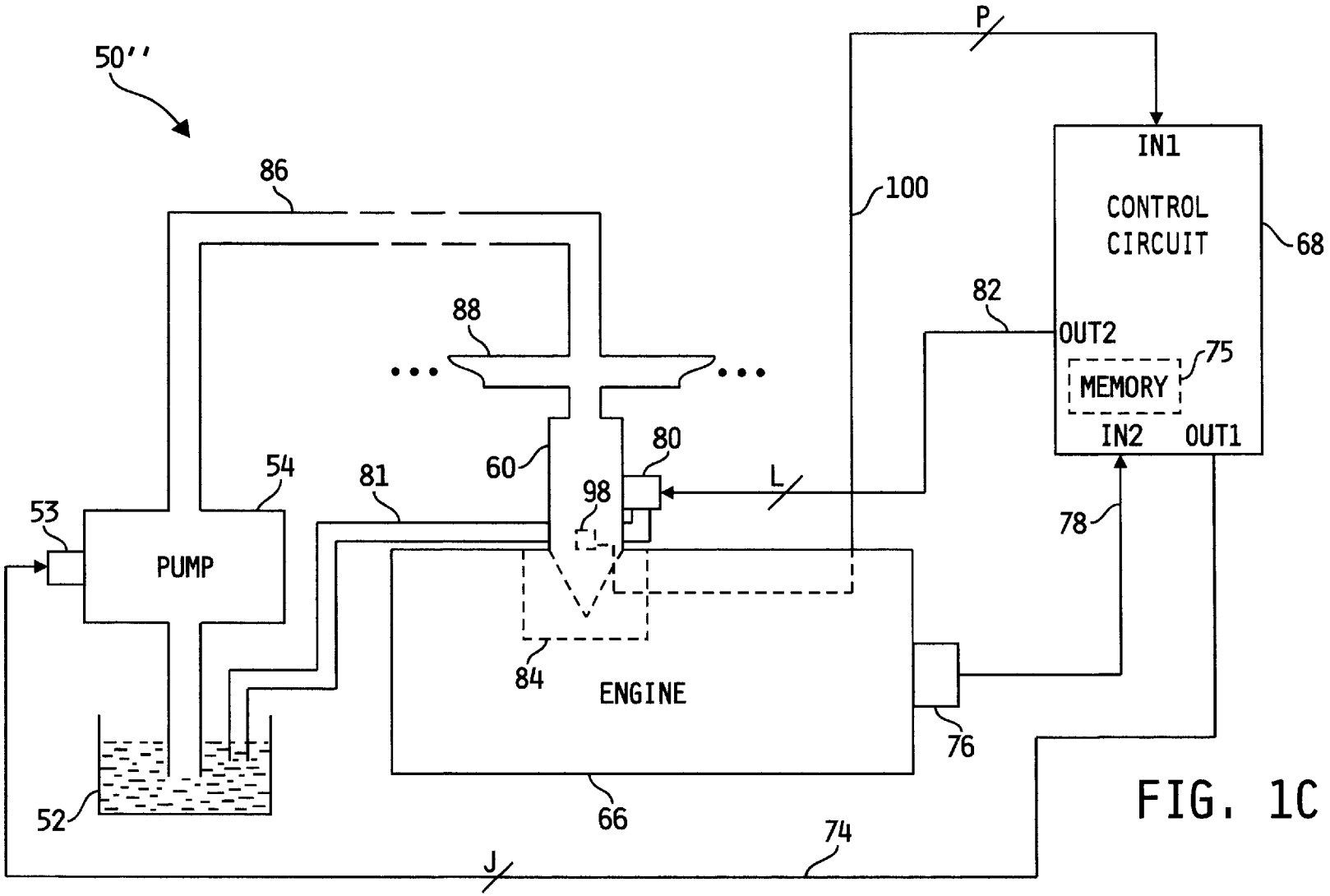
FIG. 1C is a diagrammatic illustration of another alternate embodiment of a fuel control system for an internal combustion engine, in accordance with the present invention.

Referring now to FIG. 1C, yet another alternative embodiment of an electronic fuel control system 50", in accordance with the present invention, is shown. System 50" is identical in many respects to systems 50 of FIG. 1A and 50" of FIG. 1B, and like reference numbers are therefore used to identify like components. System 50" of FIG. 1C differs from systems of FIGS. 1A and 1B in that fuel pump 54 may be fluidly connected directly to a fuel rail 88 via supply passage 86, or may alternatively be fluidly coupled thereto via an accumulator-type fuel collection unit (e.g. fuel collection unit 56 of FIG. 1A), and illustration of these two alternatives are represented in FIG. 1C as a dashed-line connection between supply passage 86 and fuel rail 88. For purposes of the present invention, system 50" of FIG. 1C may include any of the foregoing fuel supply pressure sensors (e.g., pressure sensor 70, 90 or 94) described with respect to FIGS. 1A and 1B, although such sensors are not specifically illustrated in FIG. 1C. Additionally, system 50" preferably includes a sensor 98 internal to fuel injector 60 and electrically connected to input IN1 of control circuit 68 via a number, P, of signal paths 100, wherein P may be any positive integer. In this embodiment, sensor 98 is operable to provide a signal on signal paths 100 that is indicative of the pressure of fuel dispensed by injector 60 into the combustion chamber 84, or that is alternatively a signal related to the operation of fuel injector 60 that may be used to augment or facilitate the determination of fuel injection pressure. As with systems 50 and 50' illustrated in FIGS. 1A and 1B respectively, system 50" of FIG. 1C may include any number of fuel injectors 60, any number of fuel rails 88 fluidly connected to any desired combinations or groupings of fuel injectors 60, and any number of fuel pumps 54 fluidly connected to the one or more fuel rails 88 via suitable passageways 86. Sensor 98 is accordingly shown as being electrically connected to input IN1 of control circuit 68 via a number, P, of signal paths, output OUT1 of control circuit 68 is shown as being electrically connected to actuator 53 of fuel pump 54 via a number, J, of signal paths and output OUT2 of control circuit 68 is shown as being electrically connected to fuel injector actuator 80 via a number, L, of signal paths. In one particular embodiment, for example, system 50" includes six fuel injectors 60, two fuel pumps 54 and two fuel rails 88, wherein each of the two fuel pumps 54 is operable to supply high pressure fuel to a separate fuel rail 88, and each of the two fuel rails 88 is operable to supply fuel to a separate bank of three injectors 60 each.

Figure 2:
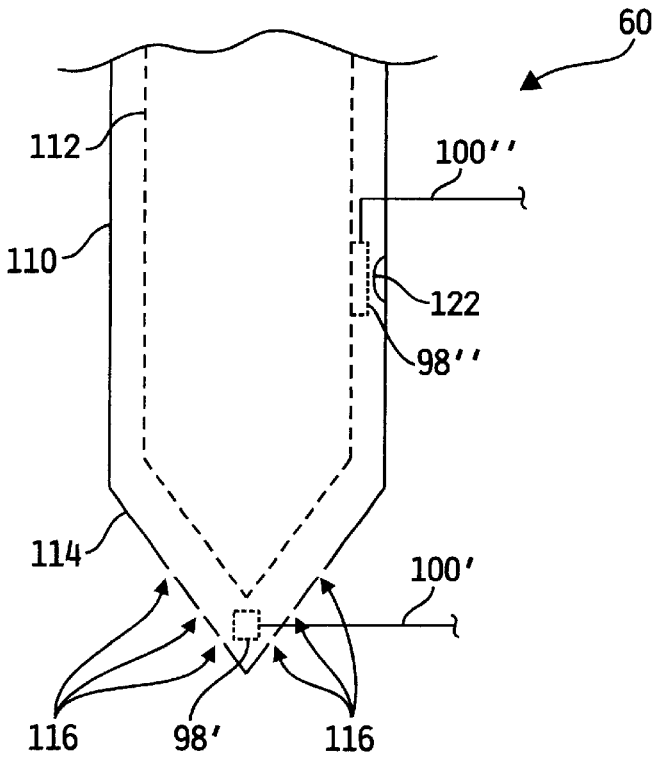
FIG. 2 is a diagrammatic illustration of some of the internal features of one embodiment of a portion of a fuel injector for use with the system of FIG. 1C.

Referring to FIG. 2, two alternative embodiments of sensor 98 are illustrated with respect to fuel injector 60. Fuel injector 60 includes an outer injector housing 110 terminating at a fuel dispensing end 114 defining a number of fuel outlet passages 116 therethrough as is known in the art. Internal to injector 60 is a needle valve 112 (shown in phantom) that is operable to retract as illustrated in FIG. 2 to thereby allow fuel to be dispensed from fuel outlet passages 116, and is further operable to form a seal against fuel outlet passages 116 to disable fuel passage therethrough as is known in the art. In one embodiment of system 50", sensor 98 is a pressure sensor 98' electrically connected to input IN1 of control circuit 68 via signal path 100'. In this embodiment, pressure sensor 98' is operable to sense the pressure of fuel being dispensed from outlet passages 116 of fuel injector 60, wherein such pressure will hereinafter be referred to as "fuel injection pressure", "injection pressure" or "sac pressure."

In an alternate embodiment of system 50", sensor 98 is a position sensor 98" electrically connected to input IN1 of control circuit 68 via signal path 100". In this embodiment, position sensor 98" is operable to sense a position of needle valve 112 relative to a known position such as, for example, structure 122 affixed to housing 110, and produce a needle valve position signal corresponding thereto. Control circuit 68 is operable to determine from the needle valve position signal whether the needle valve 112 is in a sealing position (to thereby inhibit fuel dispensing from injector 60) or in a lifted position as shown in FIG. 2 (to thereby allow fuel dispensing). Those skilled in the art will recognize that other known sensors or sensing systems may be used to determine either the sac pressure or needle valve lift, and that such other sensors or sensing systems are intended to fall within the scope of the present invention.

Figure 3:
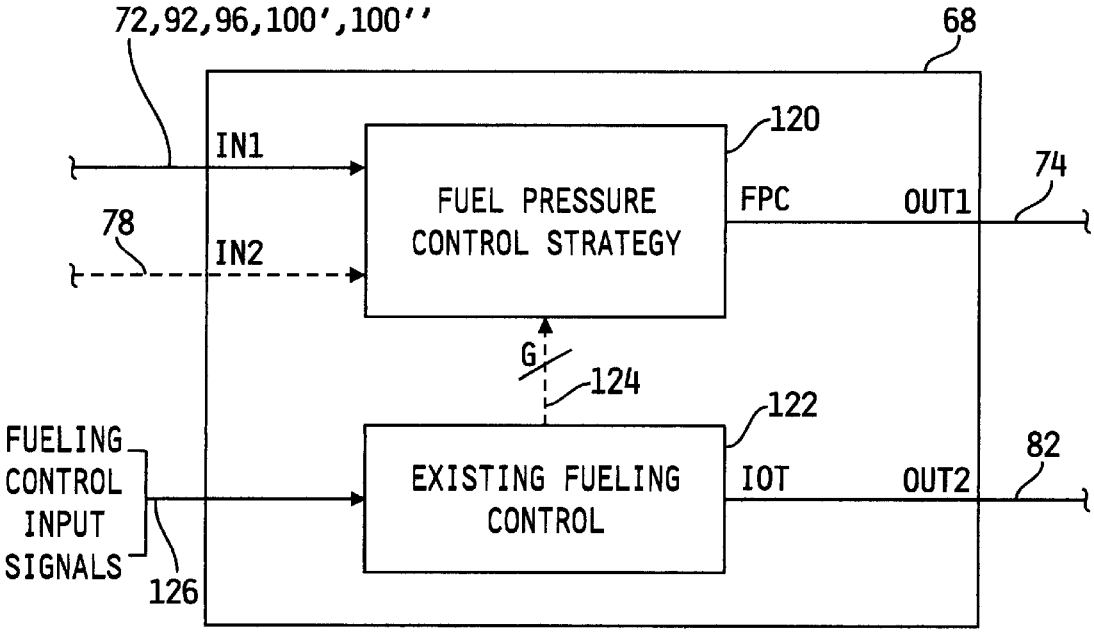
FIG. 3 is a diagrammatic illustration of one embodiment of some of the internal features of the control circuit of FIGS. 1A–1C, in accordance with the present invention.

In accordance with the present invention, control circuit 68 includes a strategy for controlling fuel injection pressure, wherein such a strategy is preferably provided in the form of a software algorithm stored within memory 75 and executable via control circuit 68. Referring now to FIG. 3, one preferred embodiment of some of the internal features of control circuit 68, as they relate to the present invention, are shown. It is to be understood that the features of control circuit 68 illustrated in FIG. 3 are not necessarily representative of physical structure within circuit 68 but may instead represent software techniques for carrying out the concepts of the present invention. In any case, control circuit 68 includes a fuel pressure control strategy block 120 receiving as inputs any one or more of the fuel pressure signals on signal paths 72, 92 or 96, the sac pressure signal on signal path 100' and/or the needle valve position signal on signal path 100". Optionally, as well be more fully described hereinafter, fuel pressure control strategy block 120 may also receive as an input the engine position signal on signal path 78 as shown in phantom in FIG. 3. In any case, control circuit 68 also includes an existing fueling control block 122 receiving a number of fueling control input signals via signal path 126, wherein block 122 is operable to control fuel injection quantities, fuel injection timing, and the like, and provides as at least one output thereof an injector on-time (IOT) signal on signal path 82. Additionally, the existing engine fueling control block 122 provides a number, G, of engine and/or fuel system operating parameter values to fuel pressure control strategy block 120 via signal path (or a number of signal paths) 124, wherein G may be any positive integer. The fuel pressure control strategy block 120 is responsive to at least some of these operating parameter values to produce a fuel pump command (FPC) signal on signal path 74 to thereby control fuel injection pressure via control of fuel pump 54, as will be described in greater detail hereinafter. Examples of such engine and/or fuel system operating parameters provided to fuel pressure control strategy block 120 by the existing fueling control block 122 include, but are not limited to, desired fuel injection pressure, engine timing, injector on-time (IOT), injector on-time delay (i.e., injector pulse delay), and the like. Additionally, injector 60 may include an intensifier configured to increase the pressure of fuel supplied by the fuel collection unit, as this term is defined hereinabove, such that the fuel pressure in the sac area (area internal to the fuel injector between the needle valve 112 and fuel dispensing orifices 116) is greater than the fuel pressure within the fuel collection unit, as is known in the art. In such cases, another engine or fuel system operating parameter that may either be included with the fuel pressure control strategy block 120 or passed thereto by the existing fueling control block 122 via signal path 124 is an intensification ratio. Fuel injection pressure may, in such cases, be computed from fuel collection unit supply pressure as a known function of the intensification ratio. Additionally still, the fuel pressure control strategy block 120 may optionally be responsive to the engine position and/or engine speed signal on signal path 78 to produce the fuel pump command signal FPC on signal path 74. Those skilled in the art will recognize alternate engine and/or fuel system operating parameters that may be used by fuel pressure control strategy 120 to produce the fuel pump control (FPC) signal, and that use of such alternate operating parameters is intended to fall within the scope of the present invention.

Figure 4:
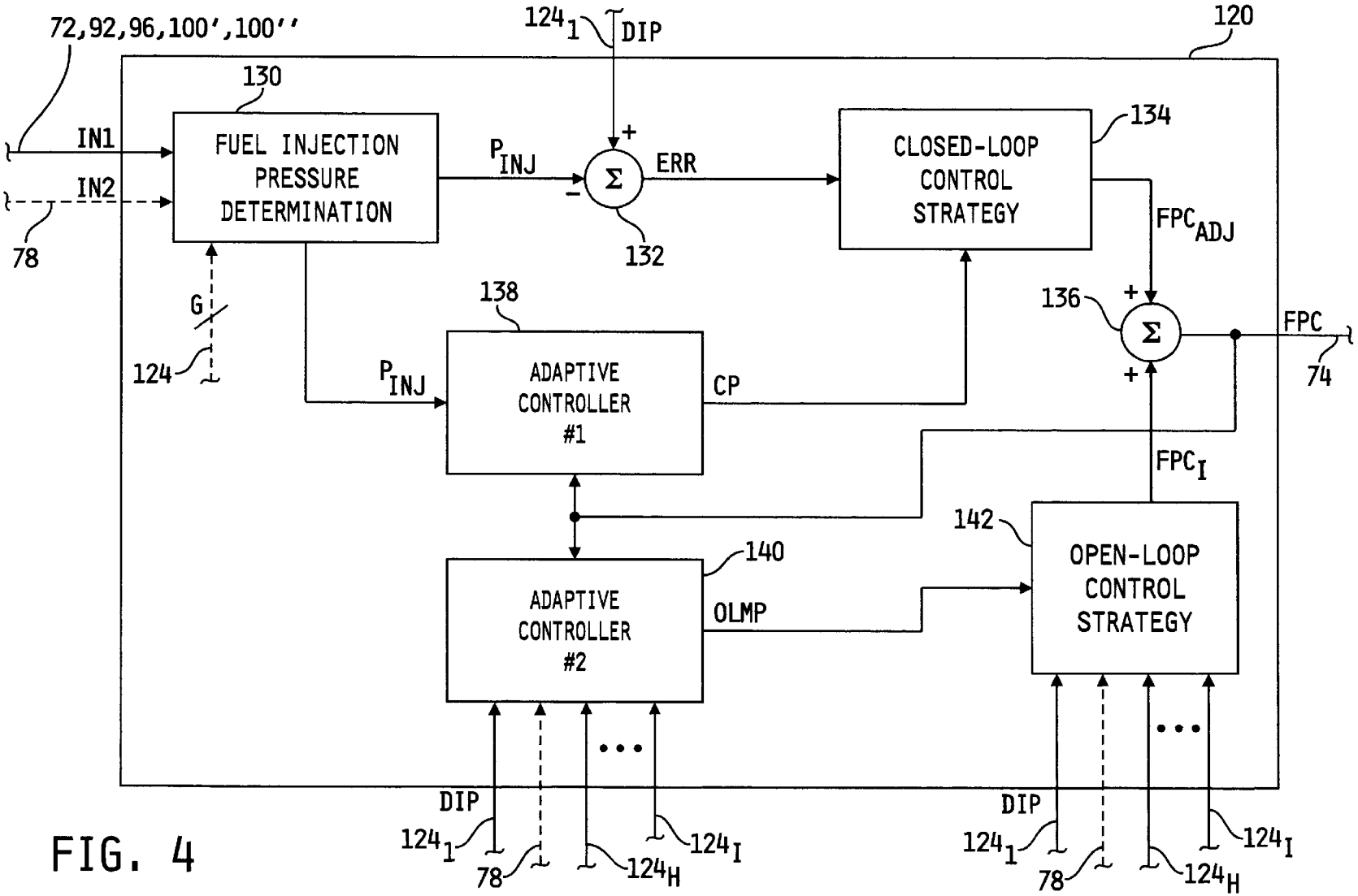
FIG. 4 is a diagrammatic illustration of one embodiment of the fuel pressure control strategy block of FIG. 3, in accordance with the present invention.

Referring now to FIG. 4, one preferred embodiment of the fuel pressure control strategy block 120, in accordance with the present invention, is shown. Block 120 includes a fuel injection pressure determination block 130 having an input connected to input IN1 of control circuit 68, and thereby receiving any one or more of the pressure signals on signal paths 72, 92 or 96 and/or needle value position signal on signal path 100". Fuel injection pressure determination block 130 is operable, in accordance with one preferred embodiment of the present invention, to process any one or more of the foregoing signals on signal paths 72, 92, 96 and/or 100" and determine therefrom a representative injection pressure value ($P_{INJ}$)

The present invention contemplates several embodiments of the fuel injection pressure determination block 130, and accordingly a number of techniques for determining representative fuel injection pressure. For example, in accordance with one embodiment of the present invention, fuel injection pressure determination block 130 is responsive to a fuel pressure signal on any of the signal paths 72, 92 or 96, as well as the engine position/speed signal on signal path 78 and an engine timing signal, injector pulse on-time (IOT) signal and injector pulse delay signal provided on signal path 124 to estimate the representative injection pressure $P_{INJ}$ as an average injection pressure according to the equation:

$$P_{INJ}=(\Sigma^{m2}_{n-m1}\text{ fuel pressure})/(m2-m1+1),$$

wherein m1=0.5*(engine timing+30) and m2=m1+(750/engine speed)*($\Sigma^{4}_{y-1}$ IOT+$\Sigma_{n=12,23,34}$ injector pulse delay), and wherein the constant values in the foregoing equations are dictated by the specific engine, vehicle, fuel system, etc. configuration. In cases wherein the fuel injector 60 includes a pressure intensifier, as this term is commonly understood in the art, the estimated fuel injection pressure is computed as a product of $P_{INJ}$ and an intensification ratio of the pressure intensifier. Those skilled in the art will recognize that the determination of $P_{INJ}$ according to the foregoing technique will depend in large part upon the particulars of the engine and fuel system, that the foregoing equation will require modification depending upon the engine and fuel system used, and that such modifications are intended to fall within the scope of the present invention. In a general sense, though, it is to be understood that determination of the average injected fuel pressure $P_{INJ}$ is a measure of the fuel storage pressure signal only during fuel injection events.

In accordance with the present invention, fuel injection pressure determination block 130 may, in this embodiment, be operable to compute an average injection pressure $P_{INJ}$ according to the previous equation as just discussed, or may alternatively be operable to receive the $P_{INJ}$ value from the existing fueling control block 122 via signal path 124. Details of one fuel control system operable to compute $P_{INJ}$ for other uses are given in co-pending U.S. patent application Ser. No. 09/565010, entitled FUEL CONTROL SYS- TEM INCLUDING ADAPTIVE INJECTED FUEL QUANTITY ESTIMATION, filed by Benson et al., and the contents of which are incorporated herein by reference.

Figure 5:
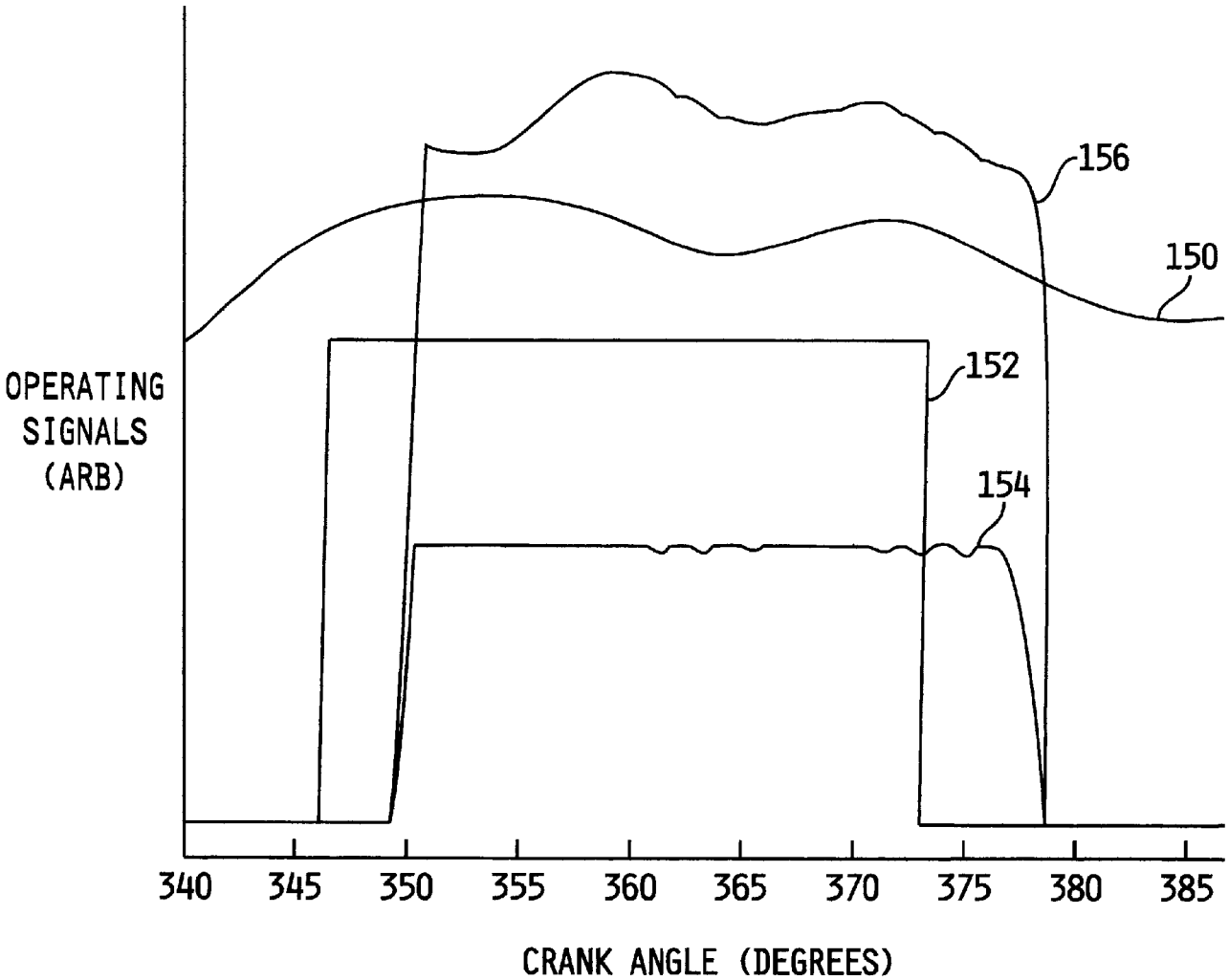
FIG. 5 is a plot of operating signals vs. time illustrating some of the electrical signals associated with the fuel injection pressure determination block of FIG. 4.

In any case, the present embodiment of block 130 recognizes that an actual fuel injection event typically lags behind the IOT signal due to inherent electro-hydromechanical delays and the like and an estimation of the representative fuel injection pressure $P_{INJ}$ must accordingly take into account an estimation of this lag. Referring to FIG. 5, an example IOT signal 152 is shown plotted against crank angle (in degrees relative to a reference engine position such as top-dead-center (TDC)), wherein sac pressure 156 is included on the same plot. As is evident from FIG. 5, the actual fuel injection event illustrated by the sac pressure signal 156 lags behind the IOT signal by 4–5 crank degrees. Sampling the fuel collection unit pressure signal (on signal paths 72, 92 and/or 96) relative to the IOT signal would thus produce incorrect results in comparison to the actual injection event shown by the sac pressure signal 156. As such, the timing, IOT, delay and engine speed signals are thus included in the foregoing equation to more accurately estimate the representative injection pressure value $P_{INJ}$.

In an alternate embodiment of fuel injection pressure determination block 130, input signals on signal path IN1 include any of the pressure signals on signal paths 72, 92 and 96. In this embodiment, sensor 98 is the needle valve position sensor 98', and block 130 is operable to receive the needle valve position signal 154 via signal path 100', and is further operable to receive from block 122 or retrieve from memory 75, an intensification ratio value. Block 130 is operable, in this embodiment, to compute a representative injection pressure value $P_{INJ}$ according to the equation:

$$P_{INJ}=(\text{intensification ratio})*(\Sigma^{p2}_{n=p1}\ \text{fuel pressure})/(p2-p1+1),$$

wherein p1 corresponds to a lifting event of needle valve 112 and p2 corresponds to a seating event of needle valve 112. Referring to FIGS. 4 and 5, block 130 is thus operable in this embodiment to monitor the position of needle valve 112 and begin sampling the appropriate fuel pressure signal (on signal path 72, 92 or 96) upon detection of a rising edge of the needle valve position signal 154 (i.e., at p1), and cease sampling the fuel pressure signal upon detection of a falling edge of the needle valve position signal 154 (i.e., at p2). The representative injection pressure $P_{INJ}$ is, in this embodiment, the average of the pressure signal readings acquired during the interval (i.e., between p1 and p2) that the needle valve 112 is lifted.

The foregoing embodiments of the fuel injection pressure determination block 130 are applicable to any of the systems 50, 50' and 50" of FIGS. 1A–1C respectively. Another alternative embodiment of block 130 is applicable specifically to system 50" of FIG. 1C wherein sensor 98 is the sac pressure sensor 98", wherein block 130 is operable to receive the sac pressure signal 156 on signal path 100" via input IN1 of control circuit 68 and compute $P_{INJ}$ according to the equation:

$$P_{INJ}=(\Sigma^{t2}_{n=t1}\ \text{sac pressure})/(t2-t1+1),$$

wherein t1 corresponds to the rising edge of sac pressure signal 156 and t2 corresponds to the falling edge of sac pressure signal 156. In this embodiment, block 130 is operable to monitor the sac pressure signal 156, begin sampling the sac pressure signal on the rising edge thereof and cease sampling the signal on the falling edge thereof. The representative injection pressure $P_{INJ}$ is, in this embodiment, the average of the sac pressure signal readings acquired during the sac pressure interval between t1 and t2.

Those skilled in the art will recognize that other known sensors or sensing systems may be used to determine a representative fuel injection pressure $P_{INJ}$ in accordance with block 130 of FIG. 4, and that such other known sensors or sensing systems are intended to fall within the scope of the present invention. For example, the representative injection pressure $P_{INJ}$ need not correspond to an average injection pressure during an injection event, but may instead correspond to one or more pressure signals at any desired time during the injection event. As a specific example, $P_{INJ}$ may correspond, in one embodiment, to the injection pressure at the start-of-injection (SOI) such that $P_{INJ}=P_{SOI}$. Those skilled in the art will recognize that other single pressure values or other functions of pressure values may be used to determine the representative injection pressure $P_{INJ}$ and that such other single pressure values or other functions of pressure values are intended to fall within the scope of the present invention.

Referring again to FIG. 4, one output of the fuel injection pressure determination block 130 is provided to an inverting input of a summing node 132 having a non-inverting node receiving a desired injection pressure (DIP) value from the existing fueling control block 122 via one of the signal paths 1241. Summing node 132 is operable to compute a difference between DIP and $P_{INJ}$ and apply a resultant error signal ERR to a first input of a closed-loop control strategy block 134. A fuel pump command adjustment value ($FPC_{ADJ}$) is provided as an output of block 134 and is directed to a non-inverting input of another summing node 136 having an output defining the fuel pump command (FPC) output value of the fuel pressure control strategy block 120. A second output of fuel injection pressure determination block 130 is operable to supply the injection pressure value $P_{INJ}$ to a first input of a first adaptive controller 138. Controller 138 includes a second input receiving the fuel pump control (FPC) signal and an output providing one or more adjusted control parameter values (CP) to a second input of the closed-loop control strategy block 134.

The closed-loop control strategy of block 134 is included to compensate for instantaneous changes in all system non-linearities, wherein the term "system non-linearities" is defined for purposes of the present invention as any and all contributions of the various pneumatic, hydraulic, electrical and mechanical components of any of the fuel control systems 50, 50' and 50" illustrated in FIGS. 1A–1C to any non-linear input/output behavior of the fuel pressure control strategy block 120. Examples of such contributions include, but are not limited to, non-linearities due to the operation of the fuel pump 54, fuel injector 60, and the like. In accordance with one preferred embodiment, closed-loop control strategy block 134 implements a known proportional-integral (PI) control strategy, although the present invention contemplates that block 134 may alternatively implement other known closed-loop control strategies and that such other known strategies are intended to fall within the scope of the present invention. Examples of such other known closed-loop control strategies include, but are not limited to, proportional-integral-derivative (PID) control strategies, pole-zero assignment control strategies, and the like. However, with any such closed-loop control strategy, the fuel injection process is somewhat complicated and its input/output relationship can be quite non-linear. As such, a conventional fixed gain closed-loop strategy of block 134 may not be able to provide appropriate stability and meet speed and accuracy requirements at all operating conditions. The adaptive controller 138 is therefore included to continuously learn the injection process via inputs $P_{INJ}$ and FPC, and to appropriately update one or more control parameters of the closed-loop control strategy 134 based on this learning process. In this manner, the adaptive controller 138 guarantees stable operation of the fuel pressure control strategy 120 at all operating conditions by adaptively adjusting at least one control parameter of strategy 134 to thereby compensate for instantaneous system non-linearities.

As a specific example of the closed-loop control function of block 120 of FIG. 4, one embodiment of a PI governor-type control strategy has a transfer function of the following form:

$$\text{correction}(k)=\text{correction}(k-1)-\text{adptgn}*(1-T_c)*\text{ERR}(k),$$

wherein "k" represents the current instant, "k−1" represents the previous instant, $T_c$ is a time constant that is preferably tunable to adjust the transient behavior of the strategy 134, and "adptgn" is an adaptive gain correction factor produced by adaptive controller 138 based on the detected system non-linearities. The adaptive controller 138 receives as inputs $P_{INJ}$ and FPC and produces the adaptive gain correction factor "adptgn" based thereon and in accordance with known techniques therefore. Preferably, adaptive controller 138 also includes a first order low-pass filter to minimize or at least reduce noise associated with the "adptgn" value, wherein the low-pass filtered "adptgn" value is supplied by controller 138 to closed-loop control strategy block 138. The closed-loop control strategy of the present invention comprising blocks 130–138 provides for ease of tuning, ease of calibration, fast response and minimal steady state error while guaranteeing stability of the control loop and minimizing overshoots and undershoots during transient operating conditions. Moreover, this closed-loop control strategy is operable to compensate for instantaneous system non-linearities to thereby provide for accurate closed-loop control at all operating conditions.

Referring again to FIG. 4, the fuel pressure control strategy block 120 further includes an open-loop control strategy block 142 receiving as inputs the desired injection pressure value (DIP) via signal path $\mathbf{124}_1$, as well as a number of additional engine and/or fuel system operating parameter values from fueling control block 122 via signal paths $\mathbf{124}_H$–$\mathbf{124}_I$. optionally, as shown in phantom, open-loop control strategy 142 may additionally or alternatively receive the engine speed/position signal via signal path 78. An output of open-loop control strategy block 142 is connected to a second non-inverting input to summing node 136 and provides an initial fuel pump command value ($FPC_I$) thereto. Open-loop control strategy 142 is operable to determine the initial fuel pump command value $FPC_I$ as a function of at least the desired injection pressure value and optionally a number of other signals input thereto. In one specific embodiment, for example, strategy 142 defines $FPC_I$ as a function of inputs DIP and engine speed/position. This or any other function defined by open-loop control strategy 142 may be embodied as a mathematical formula, model, look-up table, graph, chart or the like, and/or any combination thereof.

In any case, the fuel pump command output (FPC) of block 120 is the sum of the initial fuel pump command $FPC_I$ provided by the open-loop control strategy block 142 and the fuel pump command adjustment value $FP_{ADJ}$provided by the closed-loop control strategy 134. The operating signals and values provided as inputs to the open-loop control strategy block 142; i.e., DIP on signal path 1241, other engine and/or fuel system operating parameters on signal paths $\mathbf{124}_H$–$\mathbf{124}_I$, and optionally the engine position/speed signal on signal path 78, are also provided as inputs to a second adaptive controller 140 via corresponding signal paths. Adaptive controller 140 further receives as another input the fuel pump command signal (FPC) on signal path 74, and provides as an output a set of adjusted or updated open-loop control parameters (OLCP) based on the foregoing input signals. The open-loop control strategy block 142 receives the updated OLCP values periodically as will be more fully described hereinafter.

The open-loop control strategy consisting of block 142 and adaptive controller 140 is included within block 120 to compensate for all system variations including system non-linearities, wherein the term "all system variations including system non-linearities" is defined for purposes of the present invention as between-engine variations in system operating parameters as well as within-engine variations in system operating parameters over time, and including other noise factors and system non-linearities as this term is defined hereinabove. Examples of such other noise factors include, but are not limited to, variations in operating parameters due to changes in environment, deterioration conditions, duty cycle, and the like. In one embodiment, the open-loop control strategy block 142 is a table relating at least two of the input signals and/or values to an appropriate $FPC_I$ output as is known in the art, although the present invention contemplates that the open-loop control strategy of block 142 may alternatively define other functional relationships between the various input parameters and the $FPC_I$ output value as described hereinabove. It is to be understood that the present invention intends for such alternate open-loop control strategies to fall within the scope of the present invention.

During transient operating conditions, errors between desired and actual (measured or estimated) injection pressure may not be zero depending upon the correctness of the control parameters of the open-loop control function within block 142. Any open-loop control function shortfalls attributable to block 142 result in non-zero transient errors and overshoots and/or undershoots during transient operating conditions. The fuel pressure control strategy 120 of the present invention accordingly includes adaptive controller 140 that receives as inputs the same input signals/parameter values received by block 142. Adaptive controller 140 is operable to continuously adjust or update the signals/parameter values that define the open-loop control function within block 142 based on system variations including system non-linearities. Periodically, the adaptive controller 140 is operable to adjust or update one or more of the various control parameters of the open-loop control function within control strategy 142 by replacing its control parameters with a revised version of adjusted or updated control parameters. As used herein, the term "periodically" may be taken to mean periodic in time; i.e., after some predefined period of time has elapsed, or may alternatively be taken to mean periodic in an event; i.e., after some event has occurred or has been detected. For example, in one embodiment, adaptive controller 140 is operable to update the open-loop control strategy 142 with a revised version of control parameters sequentially after every expiration of a predefined time period. In an alternative embodiment, adaptive controller 140 is operable to update the open-loop control strategy 142 with a revised version of control parameters only upon detection of steady state operating conditions. In still another alternative embodiment, adaptive controller 140 is operable to update the open-loop control strategy 142 with a revised version of control parameters upon detection of engine shutdown; i.e., every engine ignition cycle. In still another embodiment, adaptive controller is operable to update the open-loop control strategy 142 with a revised version of control parameters only if/when the difference between one or more of the existing model parameters within strategy 142 and associated ones of the revised model parameters within controller 140 exceed corresponding threshold values. Those skilled in the art will recognize other "periodic" conditions for updating the model parameters of the open-loop control strategy block 142, and that other such conditions are intended to fall within the scope of the present invention. In any case, the result of the updating of control parameters of the open-loop control function of control strategy 142 via adaptive controller 140 results in compensating for all system variations including system non-linearities.

As a specific example of the open-loop control function of block 120 comprising blocks 136, 140 and 142, one particular embodiment of the open-loop control strategy block 142 includes a two-dimensional table having as inputs the desired injection pressure value DIP and a desired engine timing value (DET) provided by the existing fueling control strategy block 122, and produces as an output the initial fuel pump control value $FPC_I$. The adaptive controller 140 includes an identically structured two-dimensional table and receives identical inputs as block 142 as well as the fuel pump command signal FPC. Controller 142 is operable to update the table values internal thereto by continuously adjusting the DIP and DET values resident in the table, based on the FPC signal, and updating the internal table with new values under steady state operating conditions. At engine shutdown, the controller 140 is operable to replace the values of the two-dimensional table resident in the open-loop control strategy block 142 with the revised table values resident within controller 140. In this manner, the adaptive controller 140 guarantees stable operation of open-loop control strategy 142 at all operating conditions by adaptively adjusting at least one control parameter of strategy 142 to thereby compensate for system variations including system non-linearities.

The open-loop control strategy of the present invention comprising blocks 136, 140 and 142 provides for accurate yet fast response during transient and steady-state operating conditions with minimal overshoots and undershoots during such conditions. Moreover, this open-loop strategy adaptively compensates for all system variations including system non-linearities. Under normal operating conditions, the fuel pump command (FPC) is determined solely by the initial fuel pump command ($FPC_I$) and the fuel pump adjustment command ($FPC_{ADJ}$) is zero. Under conditions wherein the open loop control of the present invention (including block 142 and controller 140) is not accurate, however, the fuel pump adjustment command ($FP_{ADJ}$) is non-zero and the fuel pump command (FPC) is the sum of the initial fuel pump command ($FPC_I$) and the fuel pump adjustment command ($FPC_{ADJ}$). The combined open and closed-loop control strategies described above thus ensure fast and accurate control over fuel injection pressure while compensating for system non-linearities and all system variations such as between-engine operating parameter variations and other noise factors.

Fueling systems utilizing the control techniques of the present invention are capable of managing and adjusting fuel injection pressure, for example, at every injection event in a cyclic pressure generation system. Systems wherein the control techniques of the present invention are particularly useful include those described in U.S. Pat. Nos. 5,819,704 and 5,676,114, both of which are assigned to the assignee of the present invention, as well as systems of the type described in it co-pending U.S. patent application Ser. No. 09/565010, entitled FUEL CONTROL SYSTEM INCLUDING ADAPTIVE INJECTED FUEL QUANTITY ESTIMATION, filed by Benson et al., and the contents of which was previously incorporated herein by reference.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected.

What is claimed is:

1. A fuel injection system for an internal combustion engine, comprising:

a fuel pump responsive to a fuel pump command to supply pressurized fuel;

means responsive to at least a desired fuel injection pressure for determining said fuel pump command as a function thereof; and means responsive to at least said desired fuel injection pressure and said fuel pump command for revising said function.

2. The system of claim 1 further including:

a fuel collection unit storing said pressurized fuel supplied by said fuel pump; and a fuel injector responsive to a fuel injector actuation signal to dispense a quantity of fuel from said fuel collection unit into a combustion chamber of an internal combustion engine.

3. The system of claim 1 further including:

means for determining a fuel injection pressure corresponding to a pressure of fuel supplied by said fuel pump and dispensed into a combustion chamber of an internal combustion engine;

means responsive to said desired fuel injection pressure and said fuel injection pressure for determining a fuel pump adjustment command based on a predefined control strategy; and means responsive to said fuel injection pressure and said fuel pump command for revising at least one control parameter of said predefined control strategy.

4. The system of claim 3 wherein said means for determining a fuel injection pressure includes means for determining a fuel pressure associated with said fuel collection unit and producing a fuel pressure signal corresponding thereto.

5. The system of claim 4 wherein said means for determining a fuel injection pressure further includes means for determining said fuel injection pressure as a function of said fuel pressure signal.

6. The system of claim 5 wherein said means for determining a fuel injection pressure further includes:

means for sensing displacement of an outlet needle valve within said fuel injector and producing a displacement signal corresponding thereto; and means responsive to said displacement signal for determining said fuel injection pressure as a function of said fuel pressure signal while said displacement signal indicates that said fuel injector is dispensing fuel.

7. The system of claim 3, wherein said means for determining a fuel injection pressure includes:

means for sensing fuel pressure at a fuel dispensing outlet of said fuel injector and producing a sac pressure signal corresponding thereto; and means responsive to said sac pressure signal for determining said fuel injection pressure as a function thereof.

8. The system of claim 7 wherein said at least one control parameter includes a gain value;

and wherein said means responsive to said fuel injection pressure and said fuel pump command for revising at least one control parameter of said predefined control strategy is operable to revise said gain value.

9. The system of claim 8 wherein said predefined control strategy is a pole-zero assignment control strategy.

10. The system of claim 8 wherein said predefined control strategy is a proportional-integral control strategy.

11. A fuel injection pressure control system for an internal combustion engine, comprising:

a fuel pump responsive to a fuel pump command to supply pressurized fuel;

means for determining a fuel injection pressure corresponding to a pressure of fuel supplied by said fuel pump and dispensed into a combustion chamber of an internal combustion engine;

means for producing an initial fuel pump command;

means responsive to a desired fuel injection pressure and said fuel injection pressure for determining a fuel pump adjustment command based on a predefined control strategy;

means responsive to said fuel injection pressure and said fuel pump command for revising at least one control parameter of said predefined control strategy; and means for producing said fuel pump command as a function of said initial fuel pump command and said fuel pump adjustment command.

12. The system of claim 11 wherein said means for producing an initial fuel pump command includes:

means responsive to at least said desired fuel injection pressure for determining said initial fuel pump command as a function thereof; and means responsive to at least said desired fuel injection pressure and said fuel pump command for revising said function.

13. A fuel injection pressure control system for an internal combustion engine, comprising:

a fuel pump responsive to a fuel pump actuation signal to supply pressurized fuel;

means for determining a fuel injection pressure corresponding to a pressure of fuel supplied by said fuel pump and dispensed into a combustion chamber of an internal combustion engine; and a control circuit including a closed-loop control strategy producing a first control signal as a function of a difference between said fuel injection pressure and a desired fuel injection pressure value and an open-loop control strategy producing a second control signal as a function of at least said desired fuel injection pressure value, said control circuit producing said fuel pump actuation signal as a function of said first and second control signals.

14. The system of claim 13 wherein said closed-loop control strategy includes a gain value multiplying said difference between said fuel injection pressure and a desired fuel injection pressure value;

and further including a first adaptive controller responsive to said fuel injection pressure and said fuel pump actuation signal to produce a corrected gain value, said first adaptive controller replacing said gain value in said closed-loop control strategy with said corrected gain value.

15. The system of claim 14 wherein said closed-loop control strategy is a pole-zero assignment control strategy.

16. The system of claim 14 wherein said closed-loop control strategy is a proportional-integral control strategy.

17. The system of claim 14 said open-loop control strategy is further responsive to at least another engine operating parameter to produce said second control signal as a function thereof.

18. The system of claim 17 further including a second adaptive controller responsive to said desired fuel injection pressure value, said at least another engine operating parameter and said fuel pump actuation signal to produce an updated version of said open-loop control strategy, said second adaptive controller operable to periodically replace said open-loop control strategy with said updated version of said open-loop control strategy.

19. The system of claim 13 further including:

a fuel collection unit storing said pressurized fuel supplied by said fuel pump; and a fuel injector responsive to a fuel injector actuation signal to dispense a quantity of fuel from said fuel collection unit into said combustion chamber.

20. The system of claim 19 wherein said means for determining a fuel injection pressure includes means for determining a fuel pressure associated with said fuel collection unit and producing a fuel pressure signal corresponding thereto.

21. The system of claim 20 wherein said means for determining a fuel injection pressure further includes means for determining said fuel injection pressure as a function of said fuel pressure signal.

22. The system of claim 20 wherein said means for determining a fuel injection pressure further includes:

means for sensing displacement of an outlet needle valve within said fuel injector and producing a displacement signal corresponding thereto; and means responsive to said displacement signal for determining said fuel injection pressure as a function of said fuel pressure signal while said displacement signal indicates that said fuel injector is dispensing fuel.

23. The system of claim 19 wherein said means for determining a fuel injection pressure includes:

means for sensing fuel pressure at a fuel dispensing outlet of said fuel injector and producing a sac pressure signal corresponding thereto; and means responsive to said sac pressure signal for determining said fuel injection pressure as a function thereof.

24. The system of claim 13 wherein said fuel pump is a high pressure fuel pump operable to supply said pressurized fuel from a low pressure fuel source.

25. A method for controlling fuel injection pressure in an internal combustion engine, comprising the steps of:

determining a fuel injection pressure corresponding to a pressure of fuel dispensed into a combustion chamber of an internal combustion engine;

producing an initial fuel pump command as a function of at least one control parameter of an open-loop control strategy;

producing a fuel pump adjustment command as a function of at least one control parameter of a closed-loop control strategy;

producing a fuel pump command as a function of said initial fuel pump command and said fuel pump adjustment command, said fuel pump command controlling operation of a fuel pump supplying fuel for dispensing into said combustion chamber;

updating said at least one control parameter of said open-loop control strategy as a function of at least a desired fuel injection pressure and said fuel pump command; and updating said at least one control parameter of said closed-loop control strategy as a function of said fuel injection pressure and said fuel pump command.

26. The method of claim 25 wherein the step of producing a fuel pump adjustment command as a function of at least one control parameter of a closed-loop control strategy includes the steps of:

determining an error value as a difference between said fuel injection pressure and said desired fuel injection pressure; and determining said fuel pump adjustment command in accordance with said closed loop control strategy as a function of said error value.

27. The method of claim 25 wherein the step of producing an initial fuel pump command as a function of at least one control parameter of an open-loop control strategy includes the steps of:

determining another engine operating parameter; and determining said initial fuel pump command in accordance with said open-loop control strategy as a function of said desired fuel injection pressure and further as a function of said another engine operating parameter.

* * * * *

UNITED STATES PATENT AND TRADEMARK OFFICE

CERTIFICATE OF CORRECTION

PATENT NO. : 6,497,223 B1 
DATED : December 24, 2002
INVENTOR(S) : Tuken et al.

It is certified that error appears in the above-identified patent and that said Letters Patent is hereby corrected as shown below:

Column 8,
Line 24, after "($P_{INJ}$)" insert -- . --.

Column 10,
Line 24, please delete "1241." and replace with -- $124_1$. --.

Column 11,
Line 42, please delete "optionally," and replace with -- Optionally, --.
Line 64, please delete "1241." and replace with -- $124_l$. --.

Signed and Sealed this

Fifth Day of August, 2003

JAMES E. ROGAN
*Director of the United States Patent and Trademark Office*